US007617559B2

(12) United States Patent
Jiang

(10) Patent No.: US 7,617,559 B2
(45) Date of Patent: Nov. 17, 2009

(54) STEM STRUCTURE OF CLEANING BRUSH

(75) Inventor: Chung-Yuan Jiang, No. 30, Lane 768, Jyunsiao Rd., Zuoying District, Kaohsiung City 813 (TW)

(73) Assignees: Chung-Yuan Jiang, Kaosiung (TW); Ningeo Xianghua Automobile accessories Manufacturer Co.,Ltd., Zhejiang (CN)

( * ) Notice: Subject to any disclaimer, the term of this patent is extended or adjusted under 35 U.S.C. 154(b) by 0 days.

(21) Appl. No.: 12/015,640

(22) Filed: Jan. 17, 2008

(65) Prior Publication Data

US 2009/0183330 A1 Jul. 23, 2009

(51) Int. Cl.

| | |
|---|---|
| ***A47L 13/02*** | (2006.01) |
| ***A47L 13/12*** | (2006.01) |
| ***A46B 5/00*** | (2006.01) |

(52) U.S. Cl. ..... 15/111; 15/144.1; 15/144.3; 15/144.4; 15/172

(58) Field of Classification Search ..... 15/144.1, 15/144.3, 144.4, 236.02, 176.1, 176.2, 176.3, 15/176.4, 175.5, 176.6, 111, 145, 172
See application file for complete search history.

(56) References Cited

U.S. PATENT DOCUMENTS

| | | | | |
|---|---|---|---|---|
| 2,946,076 | A * | 7/1960 | Morgan | 15/236.02 |
| 3,271,806 | A * | 9/1966 | Helmken | 15/176.3 |
| 5,815,875 | A * | 10/1998 | Yamada | 15/167.1 |
| 6,625,837 | B2 * | 9/2003 | Jiang | 15/105 |
| 2003/0180085 | A1 * | 9/2003 | Hughes | 401/289 |
| 2004/0000018 | A1 * | 1/2004 | Choi | 15/175 |

* cited by examiner

*Primary Examiner*—Randall Chin
(74) *Attorney, Agent, or Firm*—Alan Kamrath; Kamrath & Associates PA

(57) ABSTRACT

A stem structure of a cleaning brush has a stem including a first segment having a threaded hole and at least two tabs all provided on the front end thereof, and a brush element including a body. Predetermined positions of the intermediate section of the body are provided with a through opening for receiving a threaded section of a fixing element and provided with at least two bores corresponding to the tabs. The threaded hole of the first segment of the stem is provided to screw with the threaded section of the fixing element, and the tabs of the first segment of the stem are inserted into the bores of the body. The fixing element is integrally made of plastic material.

5 Claims, 11 Drawing Sheets

Z1-Z1

STEM STRUCTURE OF CLEANING BRUSH

BACKGROUND OF THE INVENTION

1. Field of the Invention

The present invention relates to a stem structure and, more particularly, to a stem structure of a cleaning brush that may reinforce the connection of the stem and the brush element, prolonging the service life of the cleaning brush.

2. Description of the Prior Arts

A conventional cleaning brush includes a brush element connecting with a stem by way of a plurality of metal screws. However, if the brush element contacts with water after a period of time, the screws will become rusty, lowering the service life of the cleaning brush.

Furthermore, if the user intends to engage or disengage the screws, he has to use a hand tool, such as a screw driver, causing an inconvenience.

The present invention has arisen to mitigate and/or obviate the afore-described disadvantages.

SUMMARY OF THE INVENTION

The primary object of the present invention is to provide a stem structure of a cleaning brush that may reinforce the connection of the stem and the brush element.

The secondary object of the present invention is to provide a stem structure of a cleaning brush, the connection of the stem and the brush element of which may only be operated by manually rotating the fixing element without using a hand tool.

Another object of the present invention is to provide a stem structure of a cleaning brush, the connector of which may be utilized to release the engagement of the third segment of the stem and the shovel member, thereby retracting the stem so as to be stored easily.

In accordance with one aspect of the present invention, there is provided a stem structure of a cleaning brush comprising a stem including a first segment having a threaded hole and at least two tabs all provided on the front end thereof, and a brush element including a body. Predetermined positions of the intermediate section of the body are provided with a through opening for receiving a threaded section of a fixing element and provided with at least two bores corresponding to the tabs. The threaded hole of the first segment of the stem is provided to screw with the threaded section of the fixing element, and the tabs of the first segment of the stem are inserted into the bores of the body. The fixing element is integrally made of plastic material.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
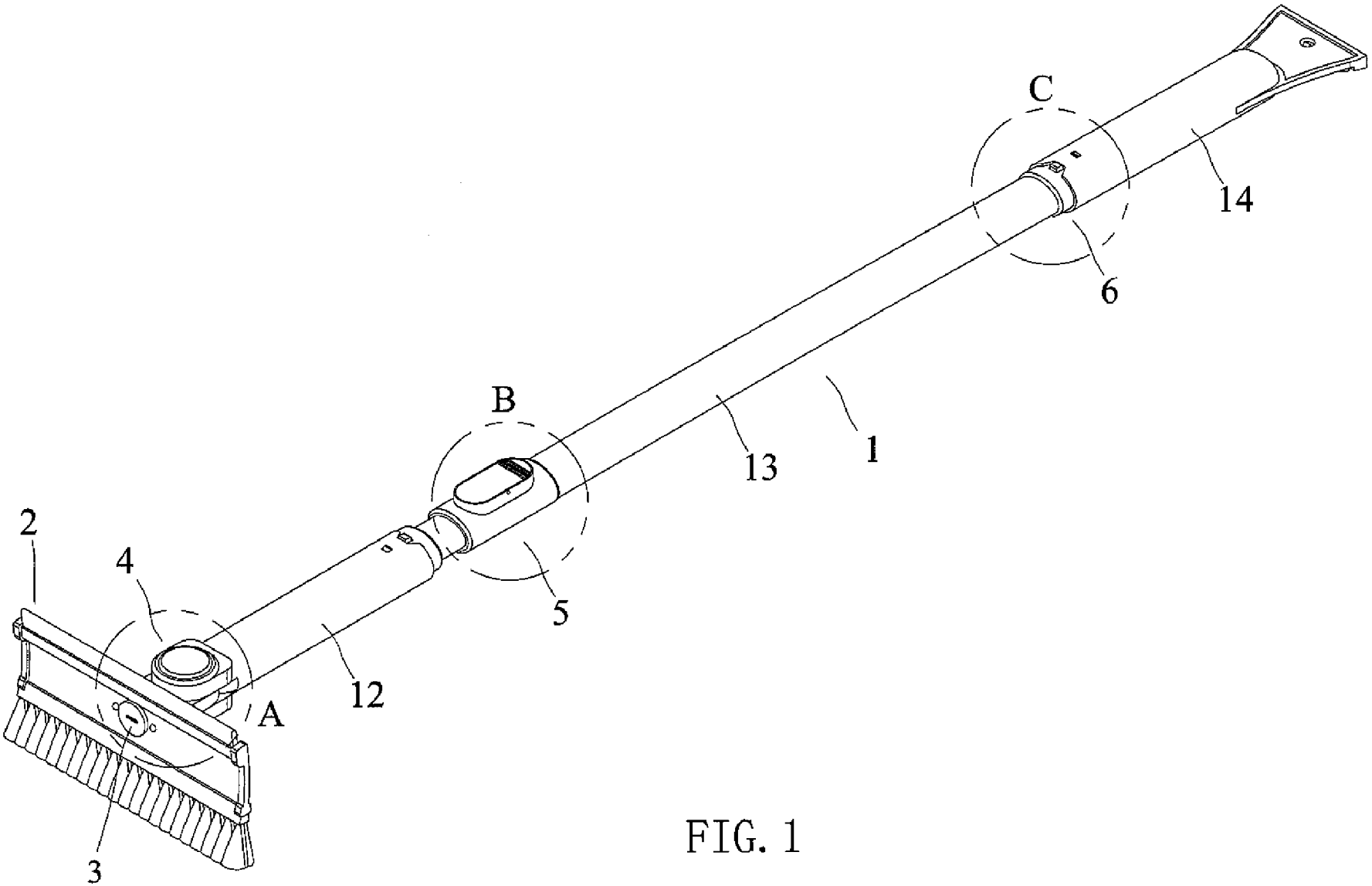
FIG. 1 is a perspective diagram illustrating the assembly of a stem structure of a cleaning brush according to the present invention.
Figure 2:
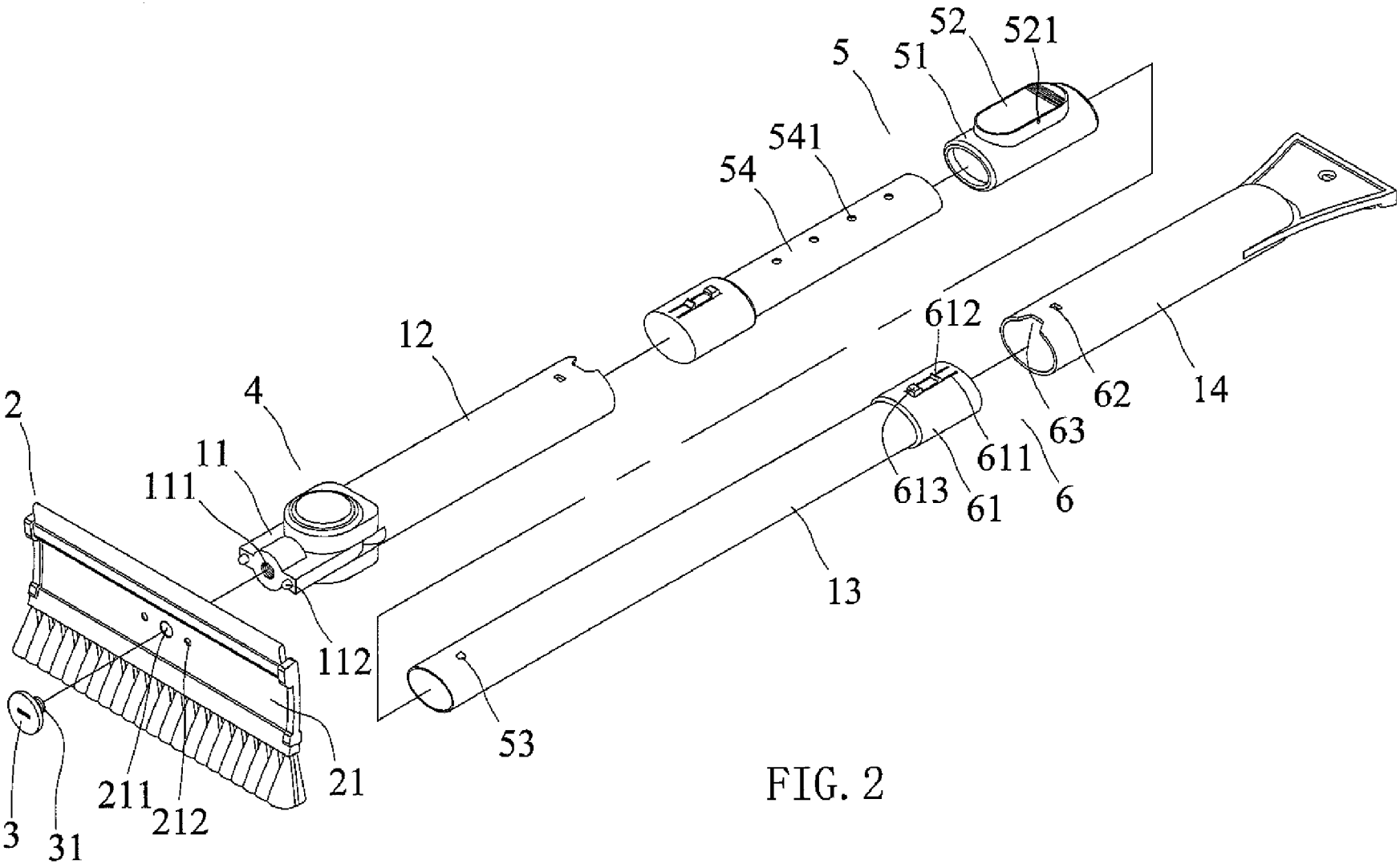
FIG. 2 is a perspective diagram illustrating the exploded components of the stem structure of the cleaning brush according to the present invention.

Referring to FIGS. 1 and 2, a stem structure of a cleaning brush in accordance with the present invention comprises a stem 1 including a first segment 11 having a threaded hole 111 and at least two tabs 112 all provided on the front end thereof, and a brush element 2 including a body 21. Predetermined positions of the intermediate section of the body 21 are provided with a through opening 211 for receiving a threaded section 31 of a fixing element 3 and provided with at least two bores 212 corresponding to the tabs 112. The threaded hole 111 of the first segment 11 of the stem 1 is provided to screw with the threaded section 31 of the fixing element 3, and the tabs 112 of the first segment 11 of the stem 1 are inserted into the bores 212 of the body 21. The fixing element 3 is integrally made of plastic material.

Figure 3:
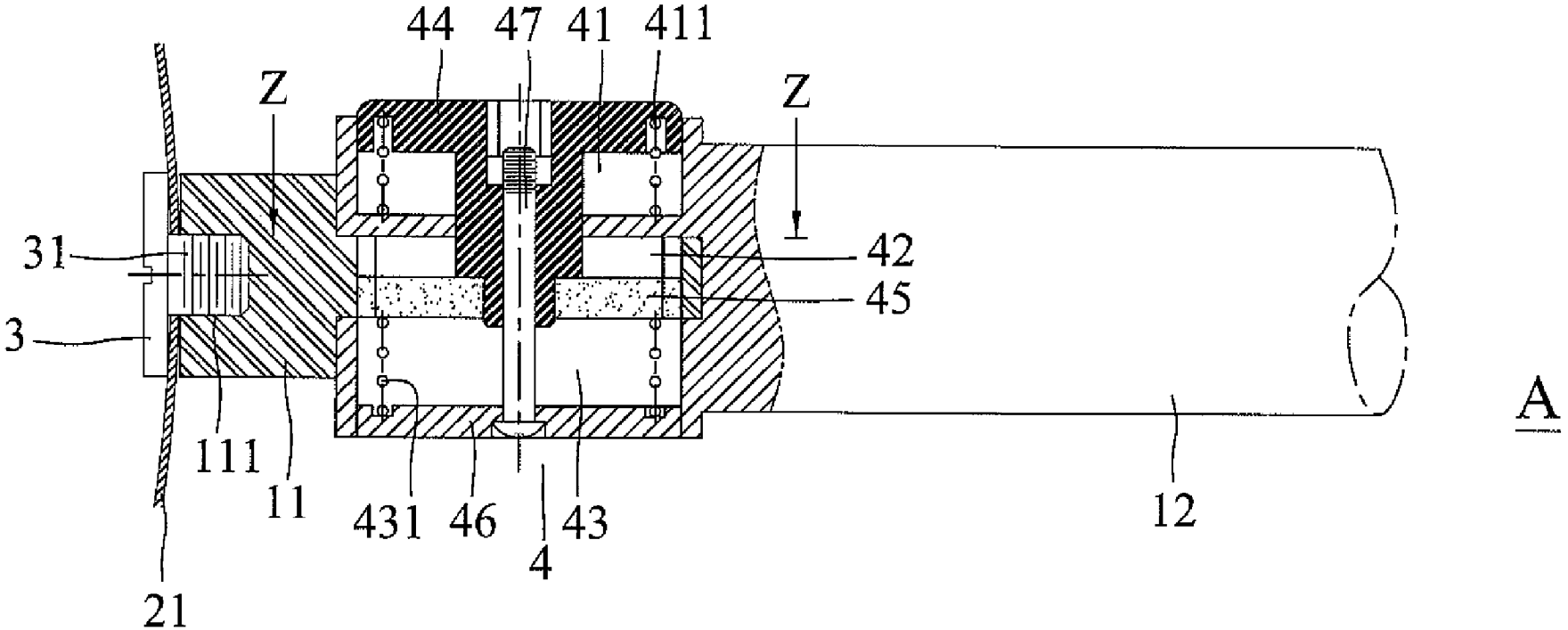
FIG. 3 is an enlarged cross sectional diagram illustrating the connection of a brush element and first and second segments of a stem as shown in part A of FIG. 1.
Figure 4:
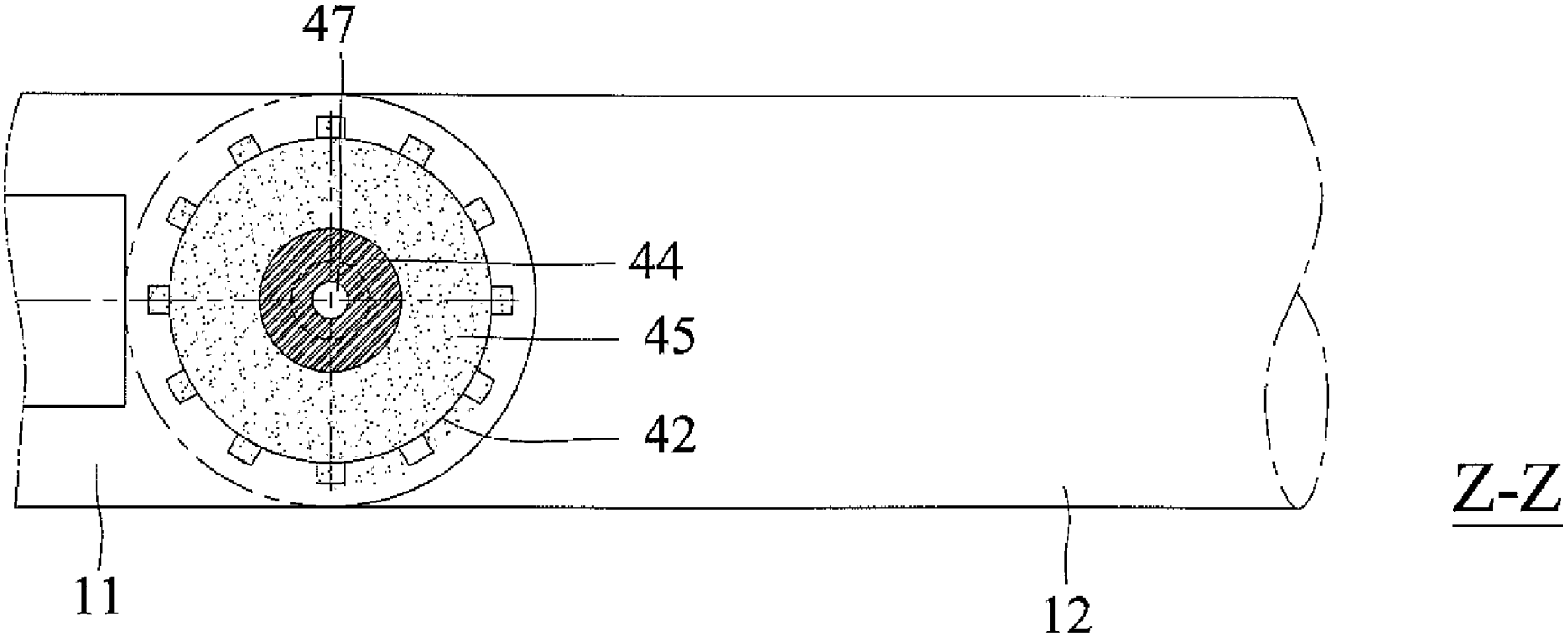
FIG. 4 is a cross sectional diagram taken along line Z-Z of FIG. 3.

As shown in FIGS. 2-4, the stem 1 includes a second segment 12. Between the first and second segments 11 and 12 of the stem 1 is attached an angle adjuster 4 including a first receiving compartment 41, a gear chamber 42, a second receiving compartment 43, a button 44, a gear disc 45, a covering 46, and a connecting shaft 47. The first receiving compartment 41 is disposed on one side of the front end of the second segment 12 of the stem 1 and includes a spring 411 mounted therein. The gear chamber 42 is affixed on another side of the first segment 11 of the stem 1. The second receiving compartment 43 is formed on another side of the front end of the second segment 12 of the stem 1 and includes a spring 431 attached therein. The button 44 is secured in the first receiving compartment 41 and inserts through the bottom of the first receiving compartment 41. The gear disc 45 acts between the gear chamber 42 and the second receiving compartment 43, and the end portion of the button 44 inserts through the gear disc 45. The connecting shaft 47 is arranged in the outer periphery of the second receiving compartment 43 and affixed at the center of the button 44.

Figure 5:
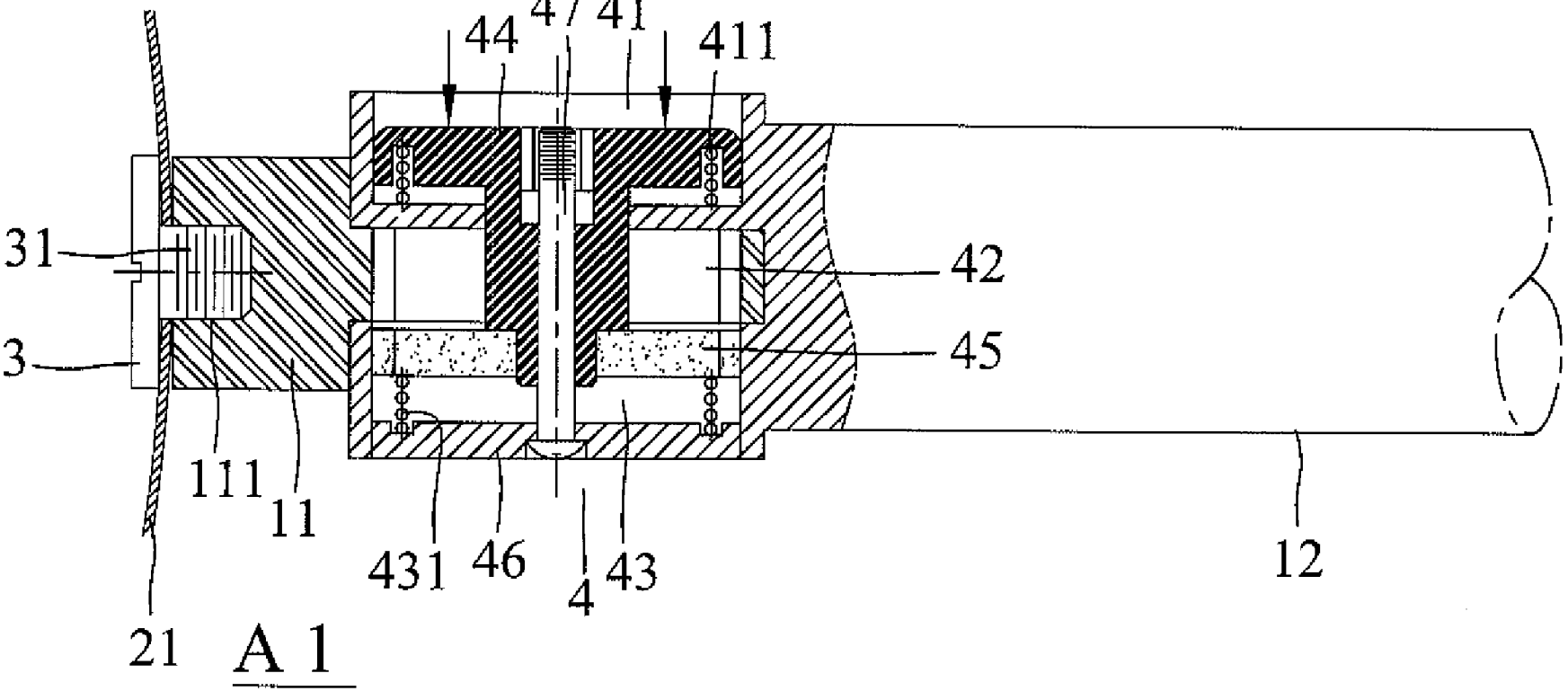
FIG. 5 is a cross sectional diagram illustrating the connection of the brush element and the first and second segments of the stem.
Figure 6:
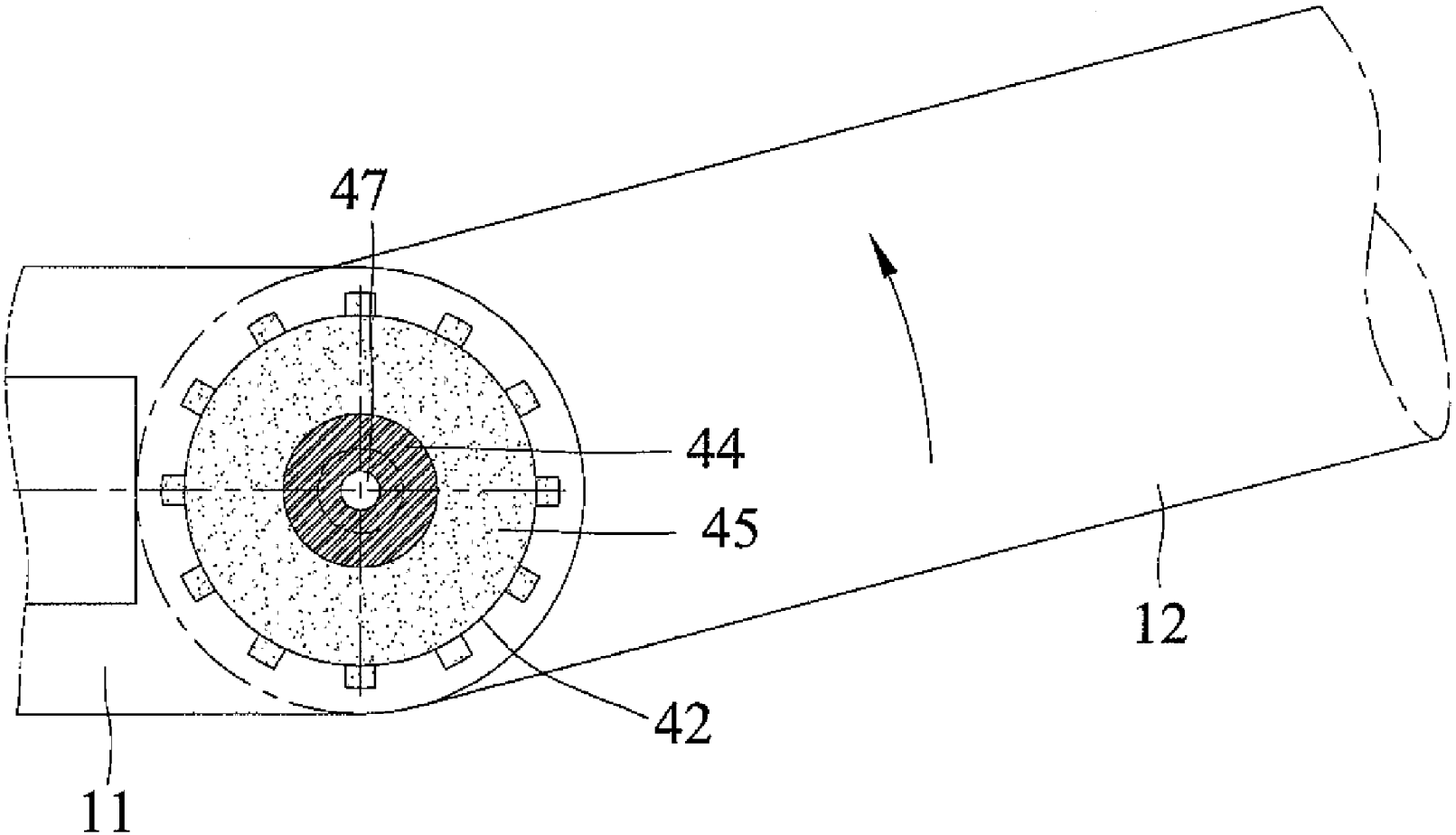
FIG. 6 is a cross sectional diagram illustrating a rotating connection of the brush element and the first and second segments of the stem taken along line Z-Z of FIG. 3.
Figure 7:
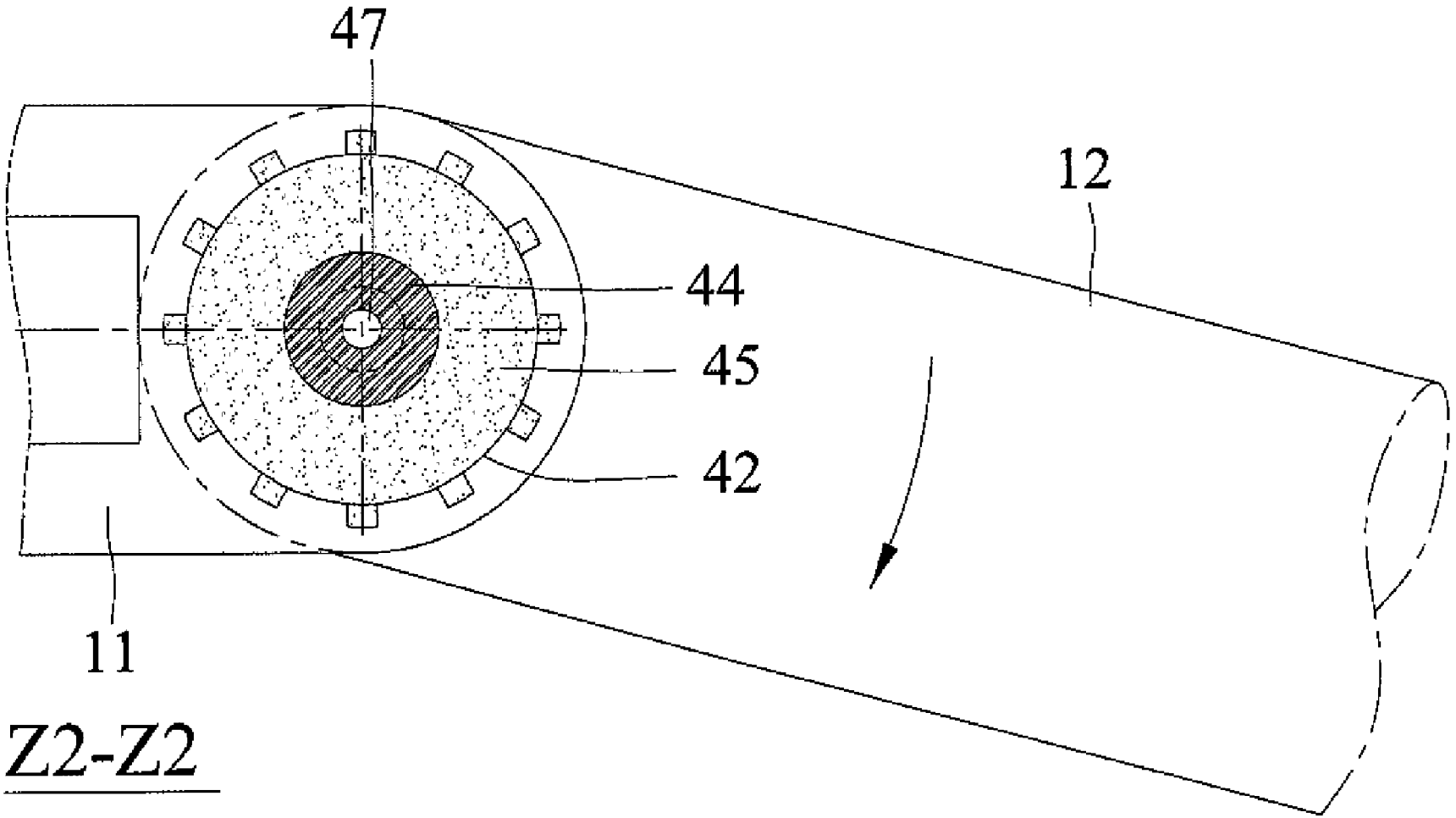
FIG. 7 is a cross sectional diagram illustrating another rotating connection of the brush element and the first and second segments of the stem taken along line Z-Z of FIG. 3.

As shown in FIG. 5, while the user presses the button 44, the gear disc 45 moves toward the second receiving compartment 43, and the connecting angle of the first segment 11 of the stem 1 and the brush element 2 may be rotated randomly (as illustrated in FIGS. 6-7), adjusting the operating angle of the brush element 2. When the user releases the button 44, the gear disc 45 returns to the gear chamber 42 by way of the resilience of the springs 411 and 431, positioning the connecting angle of the first segment 11 of the stem 1 and the body 21 of the brush element 2.

Figure 8:
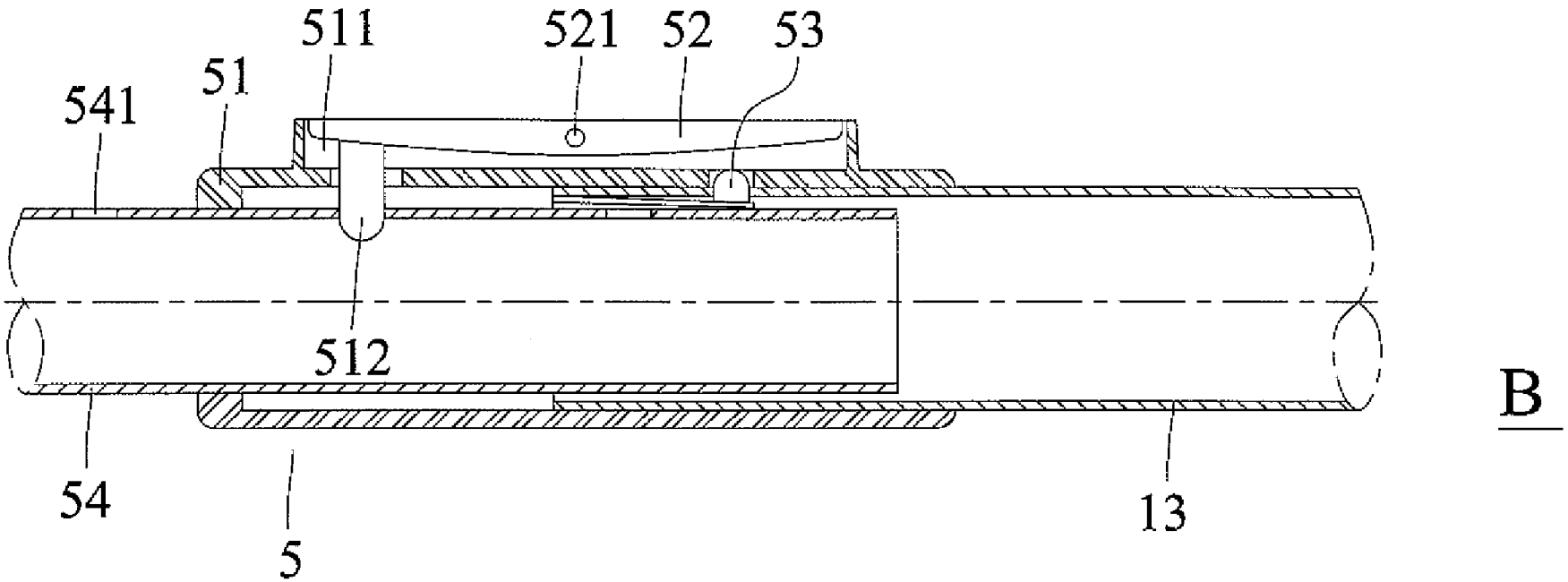
FIG. 8 is an enlarged cross sectional diagram illustrating the connection of the second and third segments of the stem as shown in part B of FIG. 1.

The stem 1 further includes a third segment 13. Between the second and third segments 12 and 13 of the stem 1 is defined a length adjuster 5 (as illustrated in FIGS. 1, 2, and 8) including a fitting element 51, an operating member 52, an elastic boss 53 and a coupling tube 54. The fitting element 51 is retained to the end portion of the third segment 13 by using the elastic boss 53 and includes a recess 511 formed on the top surface thereof. The operating member 52 is disposed in the recess 511 of the fitting element 51 so as to pivotally abut against the sidewall of the recess 511 by a pivot 521 and includes a retaining stud 512 provided under one end thereof. One end of the coupling tube 54 couples with the second segment 12 of the stem 1. On the coupling tube 54 are arranged a plurality of retaining apertures 541, and another end of the coupling tube 54 inserts into the fitting element 51 and the end portion of the third segment 13.

Figure 9:
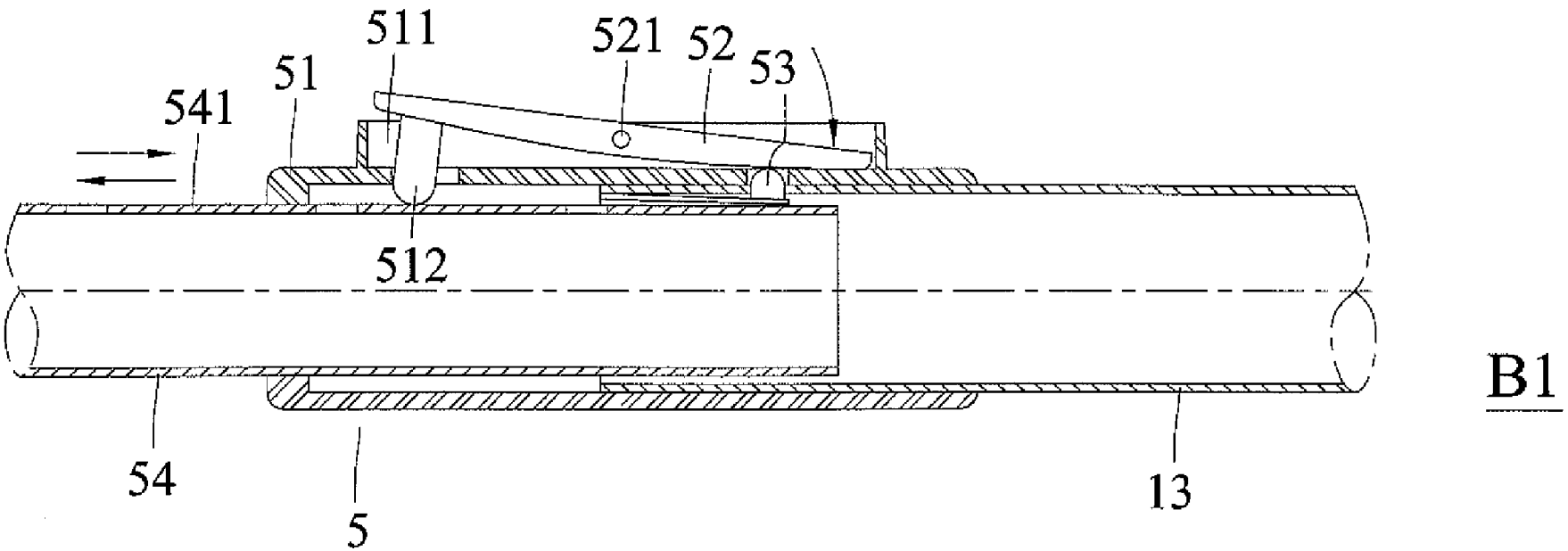
FIG. 9 is another enlarged cross sectional diagram illustrating the connection of the second and third segments of the stem as shown in part B of FIG. 1.

While the user presses one end of the operating member 52, the retaining stud 512 disengages from one of the retaining apertures 541 of the coupling tube 54 (as shown in FIG. 9). Thus, the coupling tube 54 may slidably move in the fitting element 51 and the third segment 13. As the coupling tube 54 slides inward to the fitting element 51 gradually, the operative length of the stem 1 becomes shorter and shorter. However, as the coupling tube 54 slides out of the fitting element 51 gradually, the operative length of the stem 1 becomes longer and longer. After the operative length of the stem 1 is adjusted as desired, the user presses the operating member 52. Then, the retaining stud 512 of the operating member 52 correspondingly inserts into one of the retaining apertures 541 of the coupling tube 54, thereby positioning the operating length of the stem 1.

Figure 10:
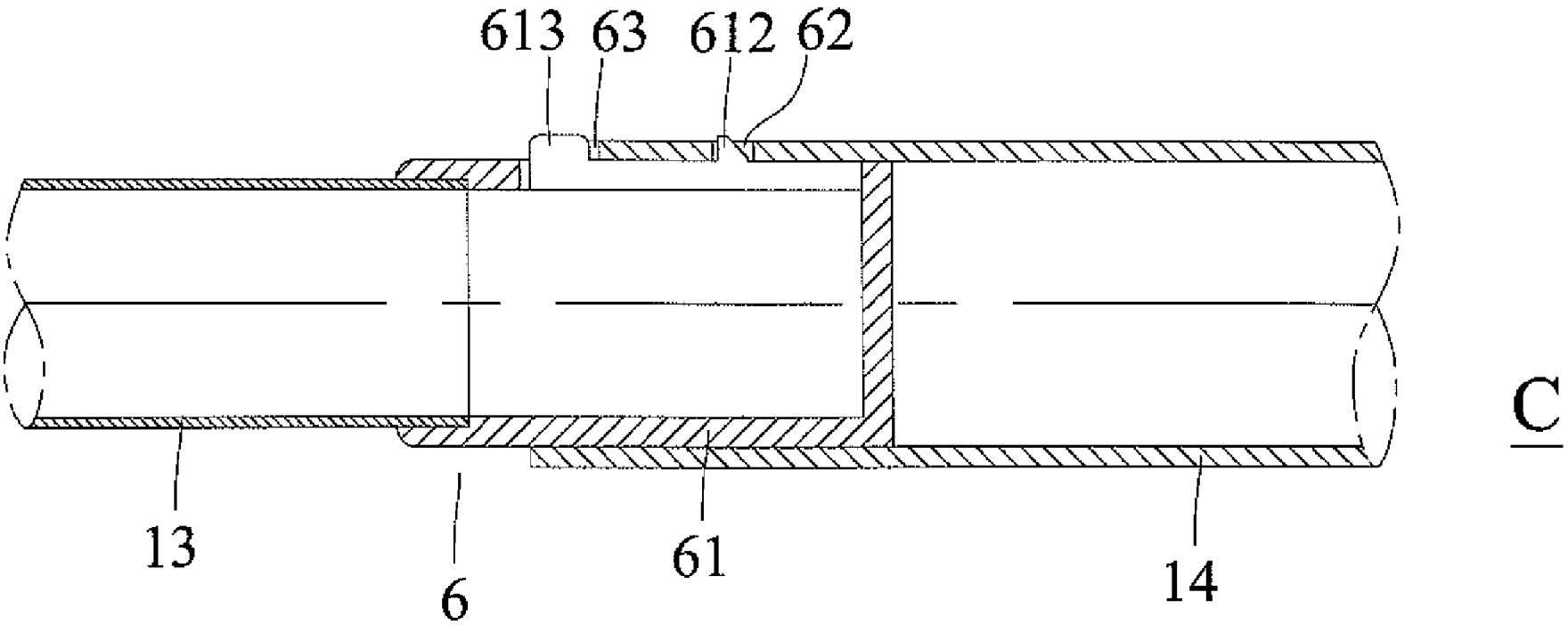
FIG. 10 is an enlarged cross sectional diagram illustrating the connection of the third segment of the stem and a shovel member as shown in part C of FIG. 1.

Between the third segment 13 of the stem 1 and a shovel member 14 is provided with a connector 6 (as illustrated in FIGS. 1, 2 and 10) including a hollow filling loop 61, an orifice 62 and a cut 63. The hollow fitting loop 61 is filled on another end of the third segment 13 of the stem 1 and includes a C-like slot 611, a retaining latch 612, and a stopper 613 all formed on the top of the exterior thereof. As the third segment 13 of the stem 1 is filled to the shovel member 14, the orifice 62 and the cut 63 may be used to receive the retaining latch 612 and the stopper 613 respectively, thus engaging the third segment 13 of the stem 1 with the shovel member 14.

Figure 11:
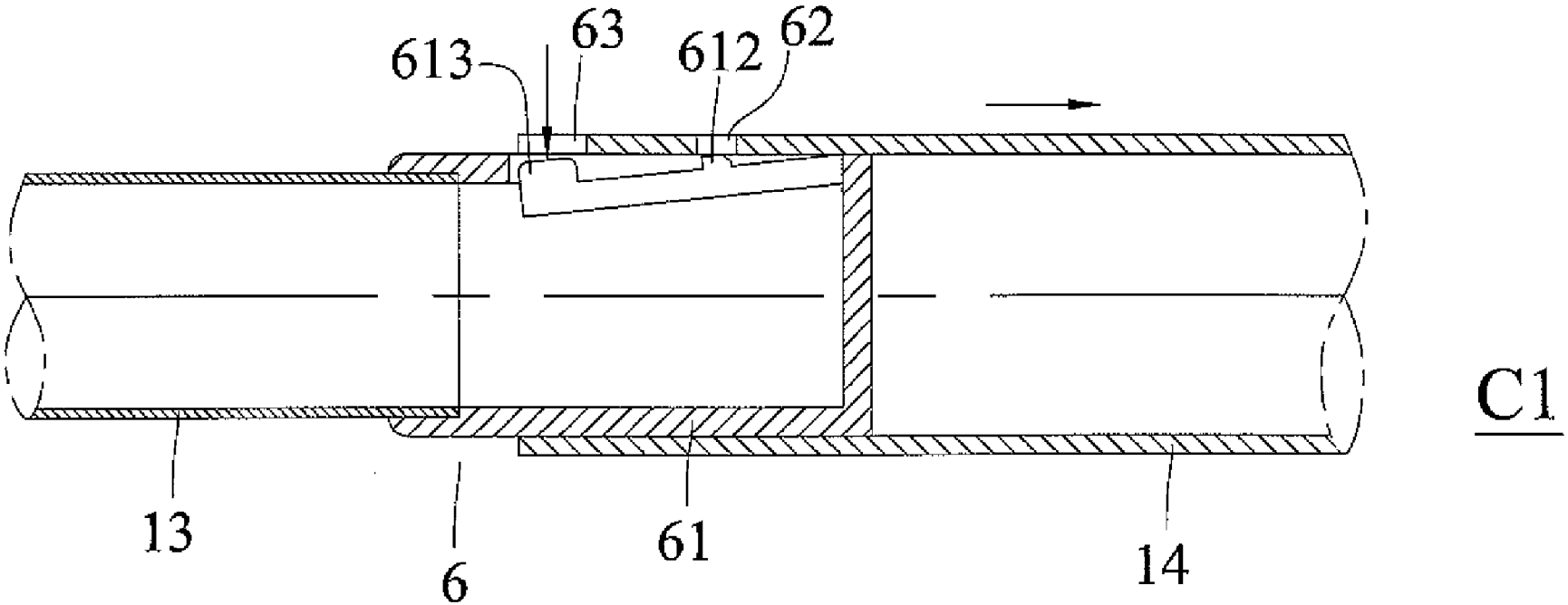
FIG. 11 is another enlarged cross sectional diagram illustrating the connection of the third segment of the stem and the shovel member as shown in part C of FIG. 1.

As shown in FIG. 11, the engagement of the third segment 13 of the stem 1 and the shovel member 14 may be disengaged easily. For example, the user merely has to press the stopper 613 of the hollow filling loop 61 so that the retaining latch 612 disengages from of the orifice 62 of the shovel member 14, releasing the engagement of the third segment 13 of the stem 1 and the shovel member 14.

It can be clearly seen from the preceding accounts on the features of the present invention that the stem structure of the cleaning brush of the present invention has the following advantages:

1. The present invention is integrally made of plastic material and includes the fixing element 3 having the threaded section 31 thereon and the tabs 112 arranged on the front end of the stem 1, thus reinforcing the connection of the stem 1 and the brush element 2.
2. The connection of the stem 1 and the brush element 2 may only be operated by manually rotating the fixing element 3 without using a hand tool.
3. The connector 6 of the present invention may be utilized to release the engagement of the third segment 13 of the stem 1 and the shovel member 14, thereby retracting the stem 1 so as to be stored easily.

The invention is not limited to the above embodiment but various modifications thereof may be made. It will be understood by those skilled in the art that various changes in form and detail may be made without departing from the scope and spirit of the present invention.

What is claimed is:

1. A stem structure of a cleaning brush comprising:

a stem including a first segment having a threaded hole and at least two tabs provided on a front end thereof;

a fixing element having a threaded section;

a brush element including a body;

a through opening in the body, with the threaded section of the fixing element received in the through opening and screwed with said threaded hole; and at least two bores in the body, with said at least two tabs of said first segment of said stem inserted into said at least two bores of said body, wherein said stem includes a second segment, wherein between said first and second segments of said stem is attached an angle adjuster including a first receiving compartment, a gear chamber, a second receiving compartment, a button, a gear disc, a covering, and a connecting shaft; said first receiving compartment is disposed on one side of a front end of said second segment of said stein and includes a spring mounted therein; said gear chamber is affixed on another side of said first segment of said stem; said second receiving compartment is formed on another side of the front end of said second segment of said stern and includes a spring attached therein; said button is secured in said first receiving compartment and inserts through a bottom of said first receiving compartment; said gear disc acts between said gear chamber and said second receiving chamber, and an end portion of said button inserts through said gear disc; said connecting shaft is arranged in an outer periphery of said second receiving compartment and affixed at a center of said button.

2. The stem structure of the cleaning brush as claimed in claim 1, wherein said fixing element is integrally made of plastic material.

3. The stem structure of the cleaning brush as claimed in claim 1, wherein said stem further includes a third segment, wherein between said second and third segments of said stem is defined a length adjuster including a fitting element, an operating member, an elastic boss and a coupling tube; said fitting element is retained to an end portion of said third segment by using said elastic boss and includes a recess formed on a top surface thereof; said operating member is disposed in said recess of said fitting element so as to pivotally abut against the sidewall of said recess by a pivot, and said operating member includes a retaining stud provided under one end thereof; one end of said coupling tube couples with said second segment of said stem, and on said coupling tube are arranged a plurality of retaining apertures, and wherein another end of said coupling tube inserts into said fitting element and the end portion of said third segment.

4. The stem structure of the cleaning brush as claimed in claim 3, wherein said stem also includes a hand tool, wherein between said third segment of said stem and said hand tool is provided with a connector including a hollow fitting loop, an orifice and a cut; said fitting loop is fitted on the another end of said third segment of said stem and includes a C-like slot, a retaining latch, and a stopper all formed on a top of an exterior of the fitting loop, wherein as said third segment of said stem is fitted to said hand tool, said orifice and said cut receives said retaining latch and said stopper respectively, thus engaging said third segment of said stem with said hand tool.

5. The stem structure of the cleaning brush as claimed in claim 4, wherein said hand tool is a shovel member.

* * * * *